US007732726B2

(12) United States Patent
Valerio

(10) Patent No.: US 7,732,726 B2
(45) Date of Patent: Jun. 8, 2010

(54) SYSTEM AND METHOD FOR SORTING DISSIMILAR MATERIALS USING A DYNAMIC SENSOR

(76) Inventor: Thomas A. Valerio, 1434 Kelton Dr., Stone Mountain, GA (US) 30083

( * ) Notice: Subject to any disclaimer, the term of this patent is extended or adjusted under 35 U.S.C. 154(b) by 289 days.

(21) Appl. No.: 12/080,793

(22) Filed: Apr. 3, 2008

(65) Prior Publication Data

US 2009/0250384 A1 Oct. 8, 2009

(51) Int. Cl.
*B07C 5/344* (2006.01)

(52) U.S. Cl. ..... 209/571; 209/552; 209/930

(58) Field of Classification Search ..... 209/44.2, 209/552, 571, 930; 324/207.11, 207.13, 324/207.15, 207.16, 207.22, 207.24, 207.26
See application file for complete search history.

(56) References Cited

U.S. PATENT DOCUMENTS

| | | | | |
|---|---|---|---|---|
| 2,587,686 | A * | 3/1952 | Berry | 209/571 |
| 3,448,778 | A | 6/1969 | Ramsay | |
| 3,568,839 | A | 3/1971 | Dunlea | |
| 3,588,686 | A | 6/1971 | Lingmann et al. | |
| 3,670,969 | A | 6/1972 | Terada | |
| 3,701,419 | A | 10/1972 | Hutter et al. | |
| 3,702,133 | A | 11/1972 | Vibert et al. | |
| 4,557,386 | A | 12/1985 | Buckley et al. | |
| 4,563,644 | A | 1/1986 | Lenander et al. | |
| 4,576,286 | A | 3/1986 | Buckley et al. | |
| 4,718,559 | A | 1/1988 | Kenny et al. | |
| 4,724,384 | A | 2/1988 | Castovilly et al. | |
| 4,848,590 | A | 7/1989 | Kelly | |
| 4,940,187 | A | 7/1990 | Lee | |
| 5,022,985 | A | 6/1991 | Nugent | |
| 5,169,073 | A | 12/1992 | Marabini | |
| 5,209,355 | A | 5/1993 | Mindermann | |
| 5,260,576 | A | 11/1993 | Sommer | |
| 5,273,166 | A | 12/1993 | Sawamura | |
| 5,314,071 | A | 5/1994 | Christian | |
| 5,344,026 | A | 9/1994 | Booth et al. | |
| 5,413,222 | A | 5/1995 | Holder | |
| 5,548,214 | A * | 8/1996 | Yasohama et al. | 324/240 |
| 5,555,324 | A | 9/1996 | Waxman et al. | |
| 5,555,984 | A | 9/1996 | Sommer | |
| 5,632,381 | A | 5/1997 | Thust et al. | |
| 5,667,151 | A | 9/1997 | Miura et al. | |
| 5,678,775 | A * | 10/1997 | Chapman | 241/79.1 |
| 5,739,524 | A | 4/1998 | Fally | |
| 5,801,530 | A | 9/1998 | Crosby | |
| 5,829,600 | A | 11/1998 | Jordan et al. | |
| 6,100,488 | A | 8/2000 | Satake et al. | |

(Continued)

OTHER PUBLICATIONS

International Search Report, PCT/US2009/001985, May 19, 2009.

*Primary Examiner*—Joseph C Rodriguez
(74) *Attorney, Agent, or Firm*—King & Spalding LLP

(57) ABSTRACT

Processing metallic materials, such as copper, from waste materials. The systems and methods employ a dynamic sensor, which measures the rate of change of current generated by metallic objects that pass by the sensor to identify metallic objects in a waste stream. The dynamic sensor may be coupled to a computer system that controls a material diverter unit, which diverts the detected metallic objects for collection and possible further processing. The systems or methods may employ stages of sensors for sequential recovery of materials.

20 Claims, 5 Drawing Sheets

U.S. PATENT DOCUMENTS 6,112,903 A 9/2000 Kimmel
6,124,560 A 9/2000 Roos
6,144,004 A 11/2000 Doak
6,191,580 B1 2/2001 Guichard
6,199,779 B1 3/2001 Mosher
6,313,422 B1 11/2001 Anibas
6,420,866 B1 7/2002 Goldberg et al.
6,452,396 B2 * 9/2002 Ott et al. ..... 324/327
6,568,612 B1 * 5/2003 Aoki et al. ..... 241/19
6,696,655 B2 2/2004 Harbeck et al.
7,674,994 B1 * 3/2010 Valerio ..... 209/571
2001/0045378 A1 11/2001 Charles et al.
2002/0074274 A1 6/2002 Pegga
2004/0144693 A1 7/2004 Tse
2007/0262000 A1 11/2007 Valerio
2010/0005926 A1 * 1/2010 Valerio ..... 75/386

* cited by examiner

SYSTEM AND METHOD FOR SORTING DISSIMILAR MATERIALS USING A DYNAMIC SENSOR

FIELD OF THE INVENTION

This invention relates to systems and methods for sorting dissimilar materials. More particularly, this invention relates to systems and methods for employing a dynamic sensor to sort metals, such as copper wiring, from waste materials.

BACKGROUND OF THE INVENTION

Recycling of waste materials is highly desirable from many viewpoints, not the least of which are financial and ecological. Properly sorted recyclable materials can often be sold for significant revenue. Many of the more valuable recyclable materials do not biodegrade within a short period, and so their recycling significantly reduces the strain on local landfills and ultimately the environment.

Typically, waste streams are composed of a variety of types of waste materials. One such waste stream is generated from the recovery and recycling of automobiles or other large machinery and appliances. For examples, at the end of its useful life, an automobile is shredded. This shredded material is processed to recover some ferrous and non-ferrous metals. The remaining materials, referred to as automobile shredder residue (ASR), which may include ferrous and non-ferrous metals, including copper wire and other recyclable materials, is typically disposed of in a landfill. Recently, efforts have been made to further recover materials, such as non-ferrous metals including copper from copper wiring. Similar efforts have been made to recover materials from whitegood shredder residue (WSR), which are the waste materials left over after recovering ferrous metals from shredded machinery or large appliances. Other waste streams may include electronic components, building components, retrieved landfill material, or other industrial waste streams. These materials are generally of value only when they have been separated into like-type materials, that is, when you concentrate the copper, plastic, or other valuable materials. However, in many instances, no cost-effective methods are available to effectively sort waste streams that contain diverse materials. This deficiency has been particularly true for non-ferrous metals, including copper wiring and non-ferrous materials, such as high density plastics. For example, one approach to recycling plastics has been to station a number of laborers along a sorting line, each of whom manually sorts through shredded waste and manually selects the desired recyclables from the sorting line. This approach is not sustainable in most economics since the labor cost component is too high. Because of the cost of labor, many of these manual processes are conducted in other countries and transporting the materials to and from these countries adds to the cost.

While ferrous and non-ferrous recycling has been automated for some time, mainly through the use of magnets, eddy current separators, induction sensors, and density separators, these techniques are ineffective for sorting copper wire. Copper wiring is a non-ferrous metal that is non-magnetic and cannot be separated by magnets.

Eddy current separators create a field of energy around non-ferrous metals, which repels the non-ferrous metal. The performance of an eddy current separator depends upon the conductivity and density of the materials as well as its shape and size. An eddy current separator will perform well on a large piece of flat aluminum, but will perform poorly on small and irregularly shaped heavier metals such as copper wire.

Density separation processes typically involve expensive chemicals or other separation media and are almost always a "wet" process. These wet processes are inefficient for a number of reasons. After separation, often the separation medium must be collected, so it can be reused. Also, these wet processes are typically batch processes, such that you cannot process a continuous flow of material.

One system that can be used to identify non-ferrous metals employs standard inductive sensors. An inductive sensor consists of an induction loop. The inductance of the loop changes according to the types of material that pass inside it. Metallic materials are greater inductors than wood, plastic, or other materials typically found in a recycle waste stream. As such, the presence of metallic materials increases the current flowing through the loop. This change in current is detected by sensing circuitry, which can signal to some other device whenever metal is detected. However, inductive sensors have limitations, both in the speed that material may move passed the detector and still be detected and sensitivity to varying sizes of metallic materials.

In view of the foregoing, a need exists for cost-effective, efficient methods and systems for sorting copper wiring and other non-ferrous metals from recycle waste streams. Such methods and systems may employ sensing technology that overcomes the limitations and inefficiencies of magnets, eddy current systems, wet processes or inductive sensors.

SUMMARY OF THE INVENTION

The present invention provides systems and methods for employing a dynamic sensor to process metals, such as copper wiring, from a waste stream. The systems and methods employ a dynamic sensor to identify metallic objects in a waste stream. The dynamic sensor may be coupled to a computer system that controls a material diverter unit, which diverts the detected metallic objects for collection. These collected metal materials may be sufficiently concentrated at this point to be sold or may be further processed to concentrate the metals.

One aspect of the present invention is a system for sorting objects in a waste material stream. The system includes a dynamic sensor and a computer coupled to the dynamic sensor, operable to receive an indication that the dynamic sensor senses a metallic object.

In another aspect of the invention, a system for sorting objects in a waste material stream is provided. The system includes multiple dynamic sensors; a conveyance system, operable to carry the waste material passed each of the dynamic sensors; a computer coupled to the dynamic sensors, operable to receive an indication that one of the dynamic sensors senses a metallic object; and a material diverter unit associated with each of the dynamic sensors, operable to receive a control signal from the computer, where the control signal activates the material diverter to divert a metal object sensed by the dynamic sensor associated with the material diverter unit.

In yet another aspect of the invention, a method for sorting objects in a waste material stream is provided. The method includes the steps of: (1) introducing the waste material on a conveyance system; (2) passing the waste material by a dynamic sensor; (3) generating an indication of the presence of a metallic object in the waste material by the dynamic sensor; (4) diverting a metallic object within the waste material indicated by the dynamic sensor when the waste material was passed by the dynamic sensor; and (5) collecting the diverted metallic object.

DETAILED DESCRIPTION OF THE EXEMPLARY EMBODIMENTS

Exemplary embodiments of the present invention provide systems and methods for processing metallic materials, such as copper, from waste materials. The systems and methods employ a dynamic sensor that identifies metallic objects in a waste stream. The dynamic sensor may be coupled to a computer system that controls a material diverter unit, which diverts the detected metallic objects for collection and possible further processing.

Figure 1:
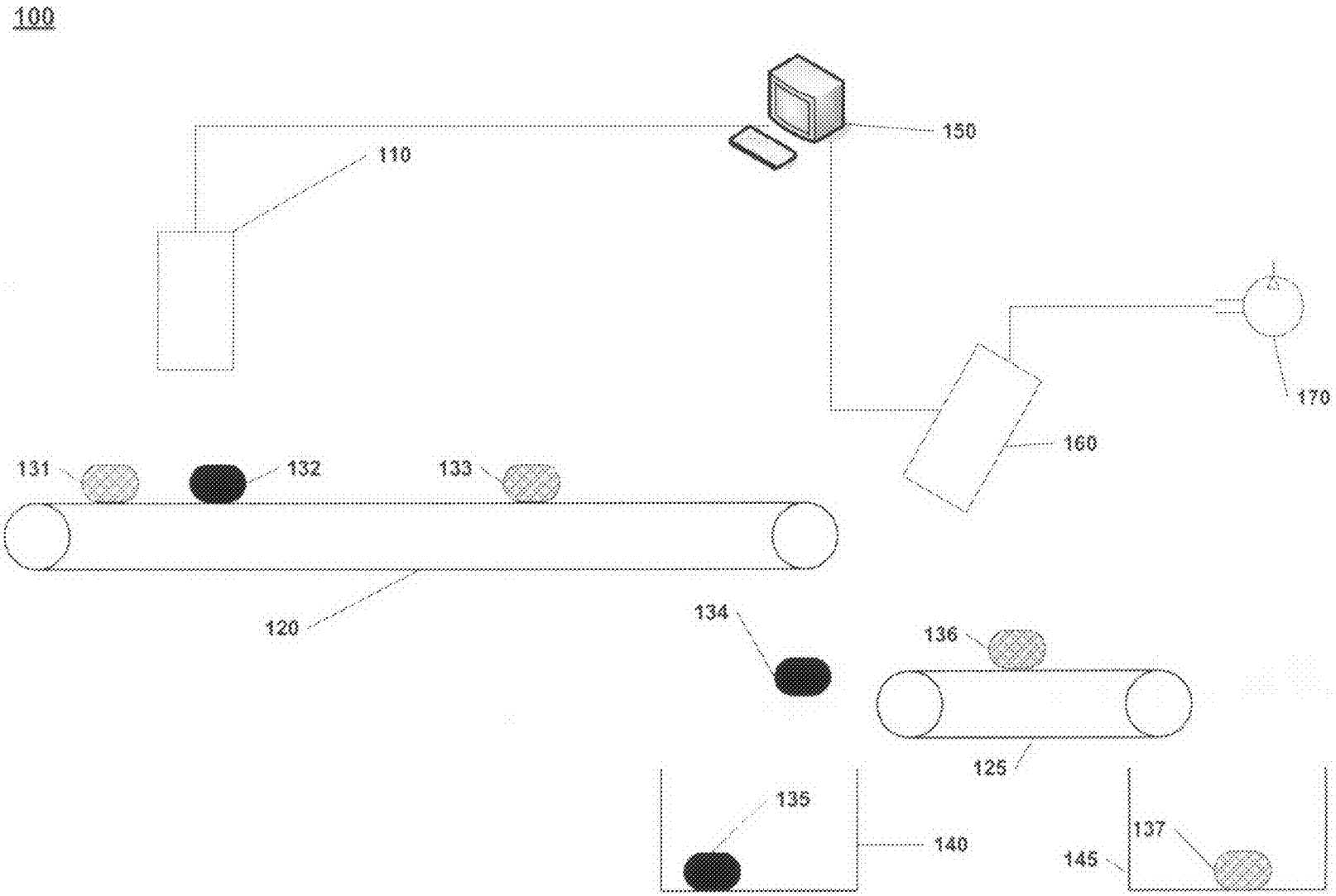
FIG. 1 depicts a dynamic sorting system in accordance with an exemplary embodiment of the present invention.

FIG. 1 depicts a dynamic sorting system 100 in accordance with an exemplary embodiment of the present invention. Referring to FIG. 1, material on a conveyor belt 120 moves under a dynamic sensor array 110. The dynamic sensor array 110 includes multiple dynamic sensors. A dynamic sensor is a modified inductive sensor. This modified sensor measures the rate of change of the amount of current produced in an inductive loop and detects the presence of metallic objects based on this rate of change. This process differs from how a standard inductive sensor detects metallic objects.

As indicated above, both an inductive sensor and a dynamic sensor employ an inductive loop to detect the presence of metallic objects. When an inductor moves through the inductive loop, a current is generated in the loop. The amount of current output from the inductive loop is directly proportional to the inductance of objects in the loop's sensing field. Metallic objects have greater inductance that non-metallic objects, such as plastics and other non-metallic materials, so a greater current is generated in the loop when metallic objects pass through it as compared to non-metallic objects. A key difference between a dynamic sensor and a standard inductive sensor is the way the detector filters and interprets the analog current level generated in the inductive loop.

In a standard inductive sensor, the analog current from the inductive loop is filtered using two criteria: the amplitude (or magnitude) of the current and the time constant of the current. In other words, for an inductive sensor to indicate that a metallic object is present, the current generated in the inductive loop must reach a specified minimum level (threshold) and remain above that threshold for a specified time interval, called the debounce, before the digital output from the sensor is turned on. This digital output is an indication of the presence of a metallic object in the monitored material. The digital output is then held on until the inductive loop current drops back below the threshold.

For example, with a standard inductive sensor, as a target metallic object approaches the sensor, the analog current in the inductive loop rises above the threshold level. The sensor waits for the debounce to time out, that is, the sensor makes sure that the current remains above the threshold for at least a minimum time. Once the current remains above the threshold for longer than the debounce time constant, the detector turns on the digital output, which remains on until the object passes, and the analog current drops back below the threshold level. If the target object was non-metallic, then the current would not rise above the threshold and the detector would not indicate the presence of a metallic object—it would not generate a digital output. Also, if a metallic object moved rapidly passed an inductive sensor, it likely would not be measured, as the current level would not remain above the threshold for longer than the debounce time. This time limitation dictates a maximum speed of materials moving passed an inductive sensor.

In contrast, the dynamic sensor takes the same analog current generated in the inductive loop and processes it based on the rate of change of the analog current over time, rather than the magnitude of the current. The rate of change of the current is determined as rise in current per unit time. When the dynamic sensor senses a change in the analog current of a minimum amount (differential) over a certain amount of time (rise time), it turns on its digital output for a specified interval (pulse time). In other words, the dynamic sensor indicates the presence of a metallic object in the material stream being measured when the rate of change of the current in the inductive loop exceeds a threshold, rather then when the magnitude of the current reaches and remains above a threshold.

As a result of this detection method, the faster a metallic object moves through the sensing field of a dynamic sensor, the faster the rise time for a current in the inductive loop and the higher the probability of the dynamic sensor detecting the presents of that metallic object. The maximum speed of objects moving through the field is limited only by the oscillation frequency of the inductive loop field and the minimum digital output pulse time.

For example, as a target metallic object approaches a dynamic sensor, the analog current in the inductive loop rises rapidly. The dynamic sensor monitors the rate of change of the analog current, and pulses the digital output as soon as the minimum differential current change occurs within the specified rise time. Thus, the sensor's digital output only turns on for a brief pulse as the leading edge of the object passes through the inductive field. The digital output remains off until another object of sufficient mass and velocity passes. This digital pulse is an indication of the presence of a metallic object in the material being monitored.

A benefit of the dynamic sensor is that it operates more effectively the faster material moves past the sensor, as compared to a standard inductive sensor. The slower belt speed required for an inductive sensor system is necessitated by the limitations of an inductive sensor. The increased belt speed for a dynamic sensor allows for a more even distribution of the materials as they are first introduced to the belt and for a greater volume of materials to be processed per unit time by a dynamic sensor system, as compared to a system employing inductive sensors.

The material introduced onto the conveyor belt 120 includes both metallic and non-metallic materials. In FIG. 1, the black objects, such as object 132, are meant to represent metallic objects while the cross-hatched objects, such as object 131, are meant to represent non-metallic objects. The objects, such as non-metallic objects 131, 133 and metallic object 132 move from left to right in FIG. 1 on conveyor belt 120. As the objects move on the belt, they pass under the dynamic sensor array 110. The sensors of the sensor array 110 detect the movement of the metallic objects and the detection signal is sent to a computer 150.

The detector array 110 includes multiple sensors. The array is configured such that more than one detector covers an area on the belt. This overlap of coverage helps to ensure that the metallic objects are detected by at least one of the sensors. An exemplary configuration of sensors in a sensor array is discussed in greater detail below, in connection with FIG. 3. The exemplary detector array 110 is depicted as stationed over the material as the material moves on the conveyor belt 120. In an alternative configuration, the detector array 110 may be contained under the top belt of the conveyor belt 120.

The computer 150, which is programmed to receive signals from the detector array 110 indicating the presence of metallic objects, also controls a material diverter unit 160. This exemplary material diverter unit 160 is an air sorter, but other types of material diverter units may be employed. For example, vacuum systems or mechanical arms featuring suction mechanisms, adhesion mechanisms, grasping mechanisms, or sweeping mechanisms could be employed.

The material diverter unit 160 includes multiple air nozzles connected to air valves. The computer sends a signal to the material diverter unit 160 to fire one or more air nozzles to divert a detected object. When a valve is triggered, a compressor 170 supplies air to one or more nozzles. The signal from the computer 150 is timed such that the air jet is delivered as the detected object falls from the conveyor belt 120. The air jet directs the detected object into a container 140, such as is depicted for objects 134, 135. This timing includes the time it takes from triggering the diversion and reaching full air pressure out the nozzles, which is 3 milliseconds in this exemplary system.

The material diverter unit 160 includes air nozzles across the width of the conveyor belt 120, so that it may act on discrete objects on the belt. An exemplary material diverter unit is described in greater detail below, in connection with FIG. 4.

In the exemplary system 100, objects that are not acted upon by the material diverter unit 160, that is, objects not detected as metallic objects by the detector array 110, fall onto a second conveyor belt 125. This second conveyor belt 125 carries non-metallic objects, such as objects 136, 137 to a container 145. In this way, the container 140 contains materials concentrated in metallic objects and container 137 has materials depleted of metallic objects. The material in container 137 may be further processed to concentrate and recover plastics, while the material is container 140 may be further processed to concentrate the collected copper or other metal.

Although conveyor belts are described here, alternative conveyance systems could be used. Also, the second conveyor belt 125 could be omitted and the container 145 positioned to receive non-diverted materials.

Either before materials, such as ASR or WSR or other waste material, are introduced to conveyor 120 or after they are processed over the dynamic sensor, they may be further processed to remove undesirable materials, that is, materials with little or no economic value if recovered. In an exemplary embodiment, the materials are further processed before they are introduced to the conveyor to increase the efficiencies of the dynamic sensors and recover a mixed material that is at least 85% copper wire. For example, the residue may be sorted with a mechanical screen or other type of size screening to remove large objects. The objects that pass through the screen would include the copper wiring or other recoverable metal, which is the principal target of this overall process.

In another preprocess step, the material may be subjected to a "roll back," or friction, belt separator. In this process, materials move along a belt, with the belt at a slight upward incline. Light, predominantly round, materials, such as foam, are less likely to move along with the belt and they roll back down the belt and are captured. Typically, this material will be disposed of.

Another preprocess step may subject the residue to a ferrous separation process. Common ferrous separation processes, which may include a belt or plate magnet separator, a pulley magnet, or a drum magnet. The ferrous separation process removes ferrous materials that were not captured in the initial processing of the shredder material. This process will also capture some fabric and carpet materials. These materials either include metal threads or trap metal fines generated during the initial processing of the waste stream where the waste, such as automobiles and or large equipment or consumer goods, was shredded and ferrous metals recovered. These trapped ferrous metal fines allow the ferrous separation process to remove these materials.

Another preprocess step may subject the materials to an air separation process. In this process, materials are introduced into the air separation system, typically from the top, and the drop by gravity through the system. Air is forced upward through the air separation system. Light materials, often called "fluff," which includes dirt, sand, fabrics, carpet, paper, and films, are entrained in the air and are removed out of one part of the system. Materials not entrained in the air are removed out another part of the system. Air separation systems may include multiple stages, or cascades, where material that falls through one stage is introduced into a second stage, and so on. The heavier material would be the material introduced onto the conveyor belt 120.

Of course, any further processing of materials could include one, two, three, or all four of these processes, either before or after the dynamic sensors and in any combination, or none of the processes. Also, other processing steps that remove undesirable materials could be employed, which may include using computer filters to isolate the frequency detection of the dynamic sensors, or using high speed cameras in combination with the dynamic sensors to cross-sort based upon shape and frequency detections, as well as other processes.

Figure 2:
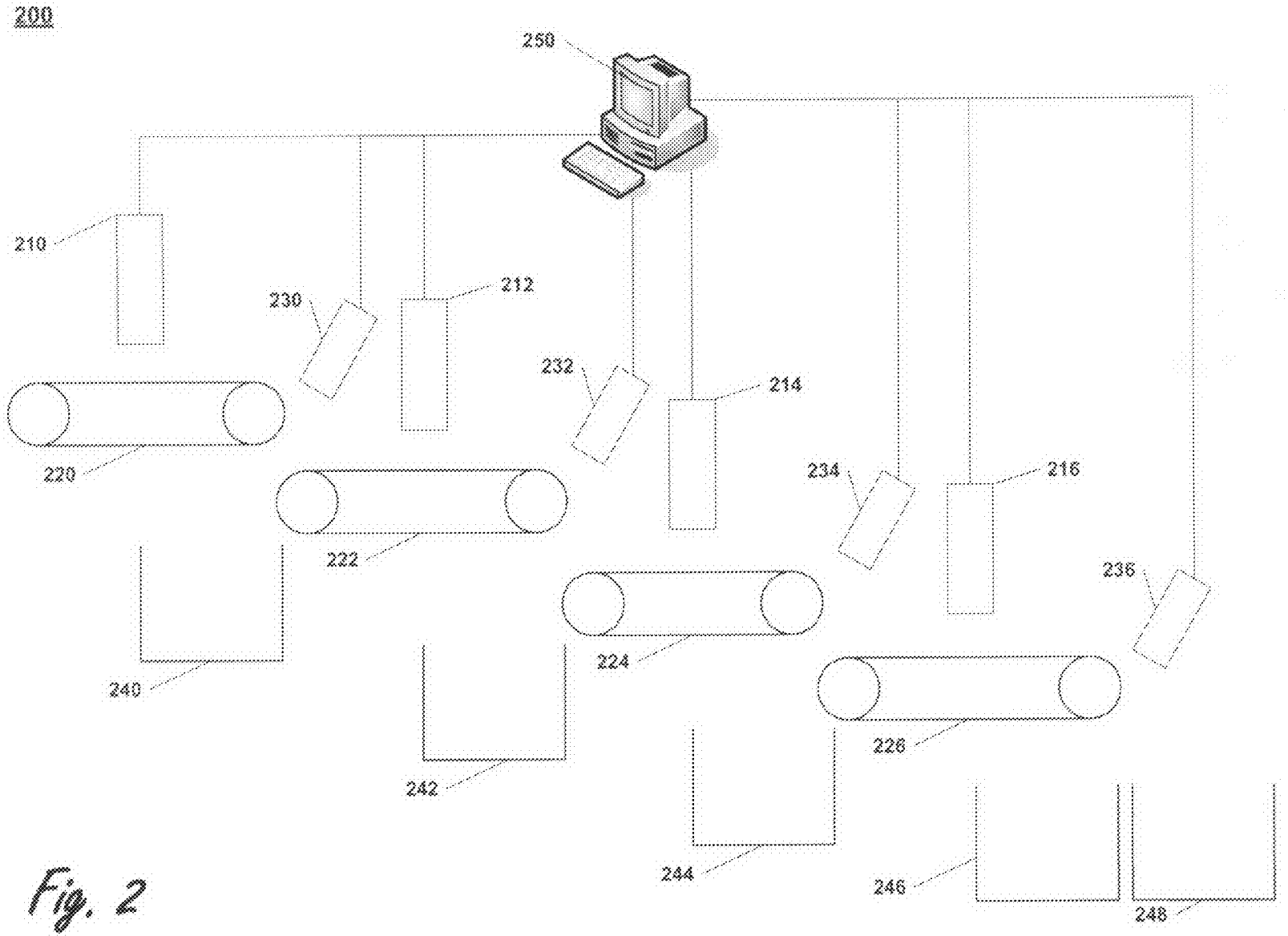
FIG. 2 depicts a dynamic sensor sorting system in accordance with an alternative exemplary embodiment of the present invention.

FIG. 2 depicts a dynamic sensor sorting system 200 in accordance with an alternative exemplary embodiment of the present invention. Referring to FIGS. 1 and 2, the system 200 includes multiple stages of detectors. Each stage is similar to the system 100, depicted in FIG. 1. In this system 200, material is introduced onto conveyor belt 220 and the material is carried past detector array 210. When the detector array 210 detects a metallic object, a signal is transmitted to a computer 250. The computer 250 controls a material diverter unit 230, which, in this exemplary system, includes multiple air nozzles controlled by valves. For example, vacuum systems or mechanical arms featuring suction mechanisms, adhesion mechanisms, grasping mechanisms, or sweeping mechanisms could be employed. The computer 250 triggers one or more valves to open and air jets divert the detected material. Air is supplied from a compressor (not shown). The signal from computer 150 is timed to actuate the valves and send the air jet as the detected object is falling from conveyer belt 220 to conveyor belt 222. Air jets would divert a detected metal object into the container 240. Materials not detected by the detector array 210 would fall onto conveyor belt 222. These materials are then carried under detector array 212 and the process is repeated. The detector array 212 sends a signal to the computer 250, which controls the material diverter unit 232 and triggers the material diverter unit 232 to divert detected metal objects into a container 242. This process is repeated for the other two stages. At the end of the process, containers 240, 242, 244, 246 contain diverted metallic objects while container 248 contains predominantly non-metallic objects.

The exemplary system 200 depicts four stages, where a stage is a combination of a conveyance, a sensor, and a material diverter unit. Of course, any number of stages could be employed. Also, the system 200 depicts a single computer 250 controlling all of the detector arrays and material diverter units. Alternatively, multiple computers could be used, such a one per stage. As with the system 100, the waste materials may be preprocessed before they are introduced onto conveyor belt 220. Also, the detector arrays may be positioned under the moving belts.

The initial material introduced onto conveyor belt 220 will have a greater concentration of metallic material than the material that falls onto belt 222. Indeed, the material that falls onto each subsequent belt would have a lower concentration of metallic materials, as metallic material is diverted from the waste stream at each stage. As a result, the first detector array 210 may be overloaded with detector "hits," that is, indications of metal objects. In one embodiment, the sensitivity of each subsequent detector array could be adjusted to prevent this overloading. For example, the detector array 210 could be set at 50 percent sensitivity, the detector array 212 could be set at 75 percent sensitivity, the detector array 214 could be set at 90 percent sensitivity, and the detector array 216 could be set at 100 percent sensitivity. This variable sensitivity could be achieved by adjusting the time filters for each sensor, such that a sensor set for a lower sensitivity would need a longer initial pulse to represent a "hit" on a metallic object. The longer initial pulse would be associated with a larger object, such that larger objects would be detected by the detector array 210, and subsequent detector arrays would detect smaller and smaller metallic objects.

Figure 3:
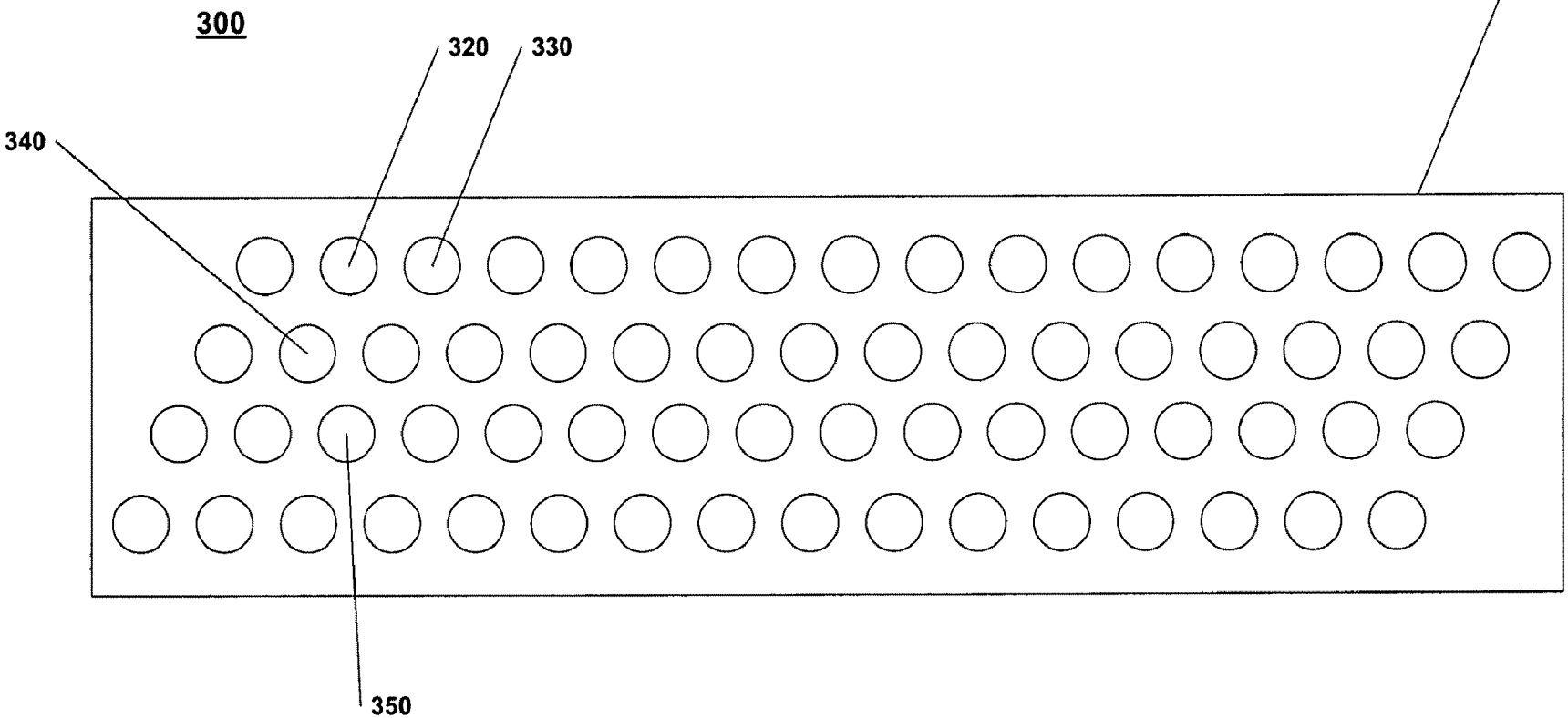
FIG. 3 depicts an array of dynamic sensors in accordance with an exemplary embodiment of the present invention.

FIG. 3 depicts an array 300 of dynamic sensors in accordance with an exemplary embodiment of the present invention. Referring to FIGS. 1, 2, and 3, the dynamic sensor array 300 includes a plate 310. The plate 310 includes holes corresponding to each dynamic sensor in the sensor array 300. In this exemplary embodiment, the sensor array 300 includes 64 individual sensors, such as sensors 320, 330, 340, 350.

In this exemplary sensor array 300, a typical pitch, that is, the distance between the center of sensor 320 and sensor 330, is 120 millimeters. Also, the typical distance between the horizontal centerline of the sensors in the row with sensor 320 and sensor 330 and the horizontal centerline of the sensors in the row with sensor 340 is 110 millimeters. The width of the sensor array 300 would be approximately equal to the width of the conveyance that moves material past the sensor array 300, such as conveyor belt 120. In that way, that sensor array 300 can detect material anywhere on the conveyance. Of course, different geometric configurations and numbers of sensors could be used in a sensor array. Indeed, a single system could employ different configurations. For example, sensor array 210 could have a different sensor configuration or number of sensors as compared with sensor array 212 in system 200.

The sensors in the sensor array 300 are arranged such that multiple sensors detect objects on the same region of the conveyance. For example, sensor 320 and sensor 350 cover approximately the same area on the conveyance. Also, the coverage area of sensor 340 overlaps with the coverage areas of sensor 320 and sensor 350. This redundant coverage increases the likelihood that the sensor array 300 will detect a metallic object in the material moving past the array.

Figure 4:
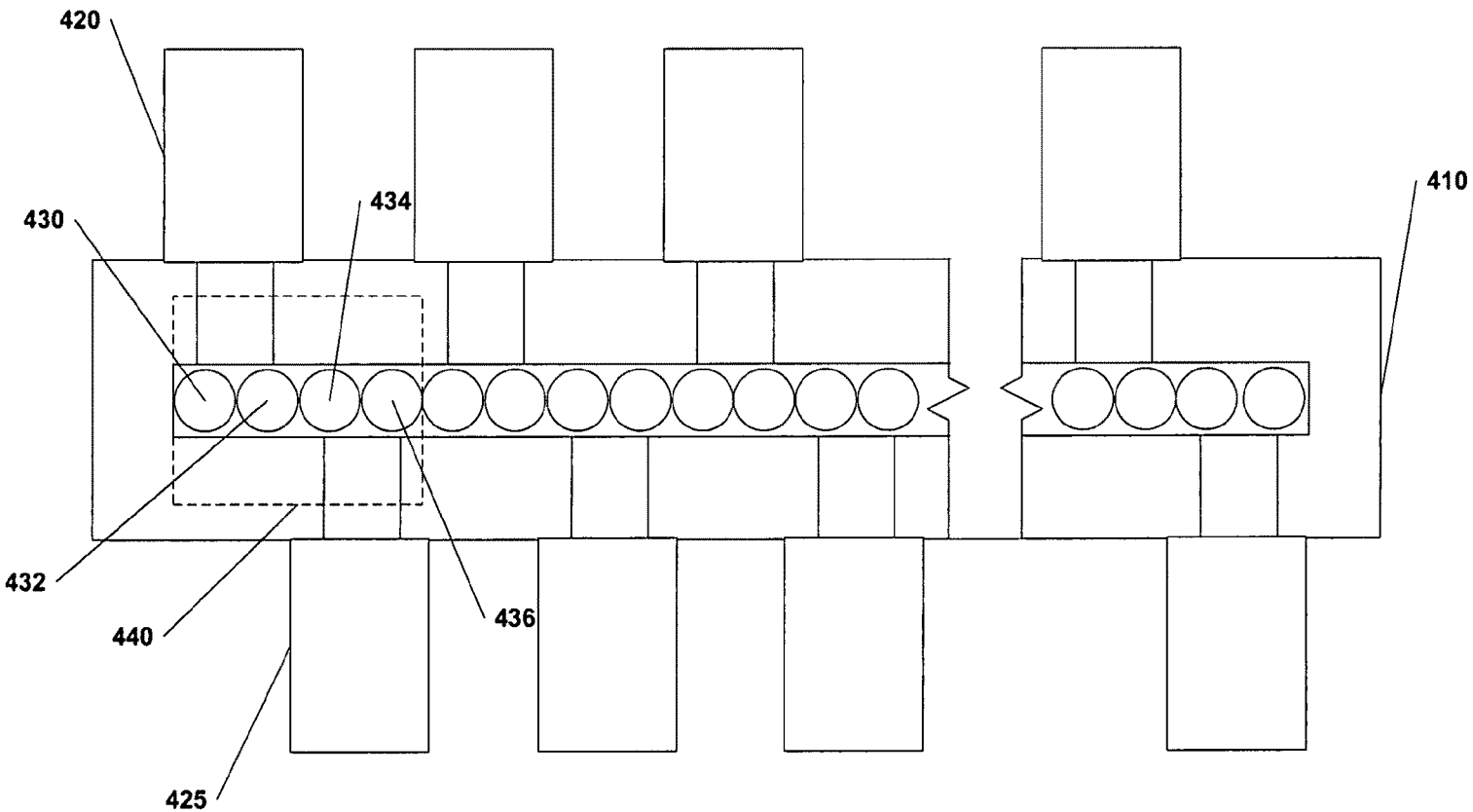
FIG. 4 depicts an air sorter in accordance with an exemplary embodiment of the present invention.

FIG. 4 depicts an air sorter 400 in accordance with an exemplary embodiment of the present invention. Referring to FIGS. 1, 2, and 4, the air sorter 400 includes a body 410. The body 410 holds a number of air valves and nozzles, such as air valves 420, 425 and nozzles 430, 432, 434, 436. As described above in connection with FIGS. 1 and 2, the air sorter 400 may be used as the material diverter unit 160 or one of the material diverter units 230, 232, 234, 236.

Each air valve in the air sorter 400 delivers compressed air to two nozzles. The compressed air is supplied to the air sorter 400 by a compressor (not shown) or other compressed air source. For example, air valve 420 delivers air to nozzles 430, 432. Similarly, air valve 425 delivers air to nozzles 434, 436.

For the air sorter 400, four nozzles correspond to a sensor on a sensor array, such as sensor array 300. All four nozzles would be supplied air at the same time to divert a detected metallic object. The box 440, indicated with a dashed line, represents the area on a conveyance, such as conveyor belt 120 that is measured by a sensor. The four nozzles 430, 432, 434, 436 would be triggered any time the corresponding sensor indicates the presence of a metallic object.

The air sorter 400 would span the entire width of the conveyance system being used, such as conveyor belt 120, so as to act on any material detected by a sensor.

Figure 5:
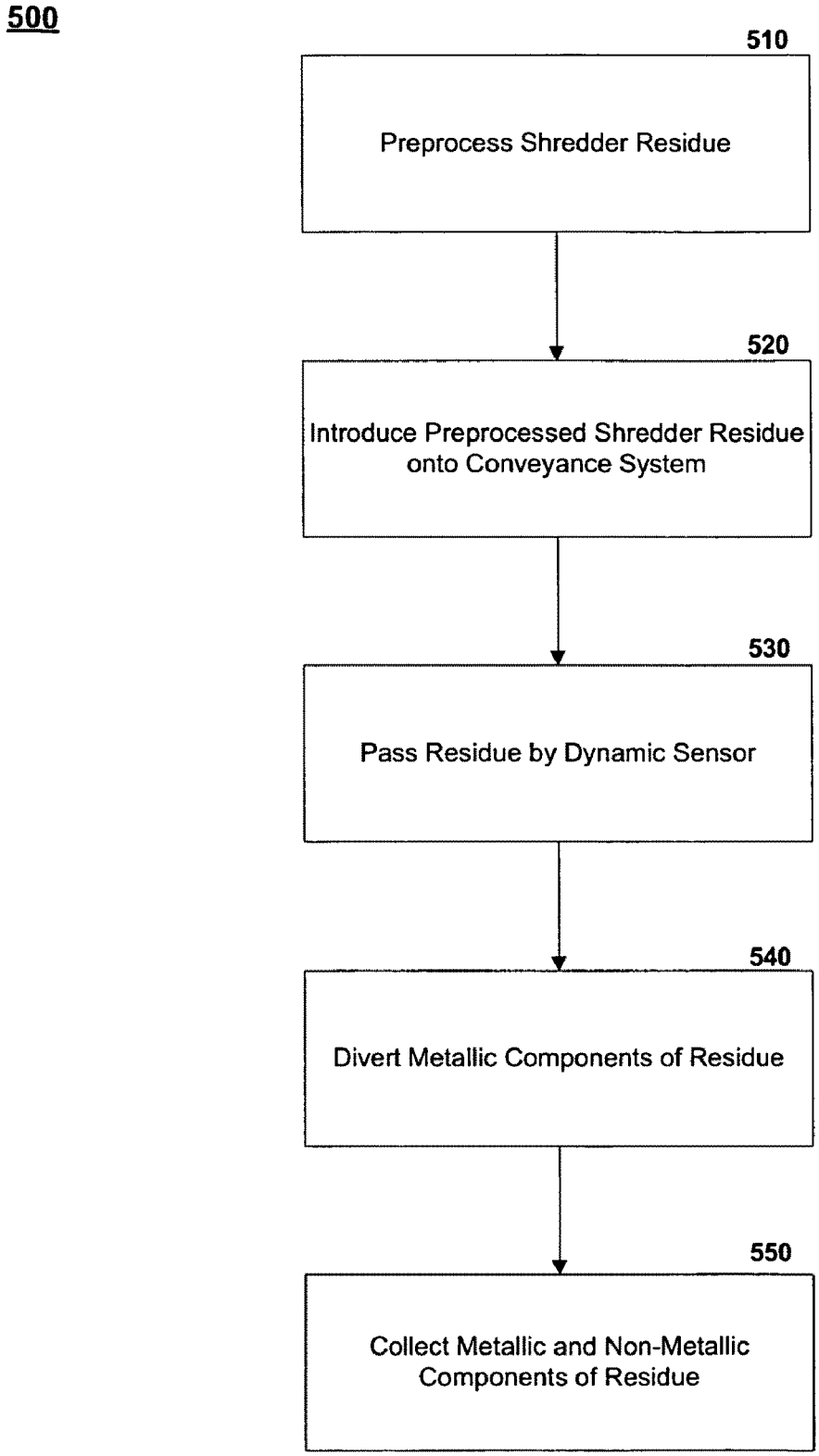
FIG. 5 depicts a process flow for processing metallic materials using a dynamic sensor in accordance with an exemplary embodiment of the present invention.

FIG. 5 depicts a process flow 500 for processing metallic materials using a dynamic sensor in accordance with an exemplary embodiment of the present invention. Referring to FIGS. 1 and 5, at step 510, shredder residue or other materials containing metallic objects, such as copper wiring or other recoverable metals, is preprocessed. As discussed above in connection with FIG. 1, a variety of preprocessing actions, such as mechanical screening, roll back separation, ferrous separation, air separation or other processes that remove undesirable materials can be employed, singularly or in combination. Of course, as discussed above, this preprocessing step can be omitted.

At step 520, the shredder residue material that is recovered from the preprocessing step 510 is introduced onto a conveyance system. An exemplary conveyance system is a conveyor belt, such as conveyor belt 120. At step 530, the material passes a dynamic sensor, such as dynamic sensor array 110.

At step 540, metallic material identified by the dynamic sensor at step 530 is diverted off the conveyance system. For example, the dynamic sensor sends a signal to a computer, such as computer 150, indicating the presence of a metallic object. The computer 150 would then trigger a material diverter unit, such as material diverter unit 160. This unit would deliver air jets to the object such that it is removed from the conveyance system. The diversion may occur when the identified object reaches the end of a conveyor belt and the air jet diverts the object into a container.

At step 550, both metallic and non-metallic components of the residue material are collected. The collected metallic materials can be further processed to concentrate the copper wire or other metal materials. The non-metallic components may also be further processed to concentrate and recover other valuable materials, such as plastics.

One of ordinary skill in the art would appreciate that the present invention provides systems and methods for processing metallic materials, such as copper, from waste materials. The systems and methods employ a dynamic sensor to identify metallic objects in a waste stream. The dynamic sensor may be coupled to a computer system that controls a material diverter unit, which diverts the detected metallic objects for collection and possible further processing.

What is claimed:

1. A system for sorting objects in a waste material stream comprising:

a dynamic sensor operable to measure the rate of change of a current generated as a result of a metallic object moving passed the dynamic sensor and further operable to generate an indication that the dynamic sensor senses the metallic object in the waste material stream based on the measured rate of change of the current; and a computer coupled to the dynamic sensor, operable to receive the indication that the dynamic sensor senses the metallic object.

2. The system of claim 1 further comprising a material diverter unit, operable to receive a control signal from the computer, wherein the control signal activates the material diverter to divert a metal object sensed by the dynamic sensor.

3. The system of claim 2 wherein the material diverter unit comprises a plurality of air nozzles operable to employ air to divert the metal object sensed by the dynamic sensor.

4. The system of claim 1 further comprising a conveyance system operable to carry objects to be sorted passed the dynamic sensor.

5. The system of claim 4 wherein the conveyance system comprises a conveyor belt.

6. The system of claim 1 wherein the dynamic sensor comprises a plurality of individual dynamic sensors forming a sensor array.

7. The system of claim 1 wherein the waste material comprises automobile shredder residue or whitegoods shredder residue and the metal object comprises copper wiring.

8. A system for sorting objects in a waste material stream comprising:

a plurality of dynamic sensors, each sensor operable to measure the rate of change of a current generated as a result of a metallic object moving passed the dynamic sensor and to generate an indication that the dynamic sensor senses the metallic object in the waste material stream based on the measured rate of change of the current;

a conveyance system, operable to carry the waste material passed each of the plurality of dynamic sensors;

a computer coupled to the plurality of dynamic sensors, operable to receive the indication that one of the dynamic sensors senses the metallic object; and a material diverter unit associated with each of the dynamic sensors, operable to receive a control signal from the computer, wherein the control signal activates the material diverter to divert a metal object sensed by the dynamic sensor associated with the material diverter unit.

9. The system of claim 8 wherein the material diverter unit comprises a plurality of air nozzles operable to employ air to divert the metal object sensed by the dynamic sensor.

10. The system of claim 8 wherein each of the plurality of dynamic sensors comprises a plurality of individual dynamic sensors forming a sensor array.

11. The system of claim 10 wherein at least two of the individual dynamic sensors detect objects in approximately the same area on the conveyance system.

12. The system of claim 8 wherein the waste material comprises automobile shredder residue or whitegoods shredder residue and the metal object comprises copper wiring.

13. The system of claim 8 wherein the plurality of dynamic sensors comprise a plurality of stages, each stage comprising a dynamic sensor and a material diverting unit.

14. The system of claim 13 wherein at least one of the plurality of dynamic sensors comprise a sensitivity that differs from the sensitivity of a second of the plurality of dynamic sensors.

15. A method for sorting objects in a waste material stream, comprising the steps of:

(a) introducing the waste material on a conveyance system;

(b) passing the waste material by a dynamic sensor operable to measure the rate of change of a current generated as a result of a metallic object in the waste material stream on the conveyance system;

(c) generating an indication of the presence of a metallic object in the waste material by the dynamic sensor based on the measured rate of change of the current generated in the dynamic sensor by the metallic object;

(d) diverting the metallic object within the waste material indicated by the dynamic sensor; and (e) collecting the diverted metallic object.

16. The method of claim 15 further comprising the step of preprocessing the waste material before introducing the waste material onto the conveyance system to remove undesirable materials from the waste material stream.

17. The method of claim 16 wherein the preprocessing step comprises employing at least one of: air separation, ferrous separation, mechanical screening separation, and friction belt separation.

18. The method of claim 15 wherein the steps (a)-(e) are repeated in multiple stages, wherein each set of four steps comprise a single stage.

19. The method of claim 15 wherein the metallic object comprises copper wiring.

20. The method of claim 19 wherein the copper wiring is further processed to concentrate the copper.

* * * * *